US007195050B2

(12) United States Patent
Nien

(10) Patent No.: US 7,195,050 B2
(45) Date of Patent: Mar. 27, 2007

(54) COMBINATION WINDOW COVERING

(75) Inventor: Ming Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 434 days.

(21) Appl. No.: 10/460,478

(22) Filed: Jun. 13, 2003

(65) Prior Publication Data

US 2004/0221969 A1 Nov. 11, 2004

(30) Foreign Application Priority Data

May 6, 2003 (TW) ..... 92208270 U

(51) Int. Cl.
*E06B 9/386* (2006.01)

(52) U.S. Cl. ..... 160/168.1 R; 160/178.1 R; 160/236

(58) Field of Classification Search ..... 160/168.1 R, 160/178.1 R, 236, 89, 176.1 R
See application file for complete search history.

(56) References Cited

U.S. PATENT DOCUMENTS 2,110,145 A * 3/1938 Loehr ..... 160/89
2,994,370 A * 8/1961 Salvatore ..... 160/89
3,386,490 A * 6/1968 Kandel ..... 160/178.1 R
3,490,515 A * 1/1970 Kandel ..... 160/178.1 R
4,951,729 A * 8/1990 Chi Yu ..... 160/178.3
4,984,617 A * 1/1991 Corey ..... 160/84.02
5,375,642 A * 12/1994 Gaber et al. ..... 460/168.1 R
5,775,399 A * 7/1998 Shields, Jr. ..... 160/176.1 R
5,829,506 A * 11/1998 Zorbas ..... 160/236
6,675,859 B1 * 1/2004 Nien ..... 160/89

* cited by examiner

*Primary Examiner*—David Purol
(74) *Attorney, Agent, or Firm*—Buchanan Ingersoll & Rooney PC

(57) ABSTRACT

A combination window covering is constructed to include a headrail, a bottom rail, front and rear ladder tapes respectively vertically connected between the headrail and the bottom rail at front and rear sides, fabric slats arranged in parallel between the headrail and the bottom rail, each slat having two opposite long sides respectively embedded with a rib, which is fastened to the front and rear ladder tapes, fabric light screening flaps respectively suspended from the slats and forming a light screening face at the front side of the slats, and a control unit for operation by the user to lift or lower the bottom rail so as to further receive or extend out the slats, and to move the front ladder tapes and rear ladder tapes of the ladder tapes vertically in reversed directions so as to further tilt the slats.

12 Claims, 10 Drawing Sheets

COMBINATION WINDOW COVERING

BACKGROUND OF THE INVENTION

1. Field of the Invention

The present invention relates generally to a window covering and, more particularly, to a combination window covering which comprises a plurality of slats and a plurality of flexible light screening flaps suspended from the slats to form a light screening face at one of the front and back sides of the slats.

2. Description of the Related Art

A regular Venetian blind enables the user to control the extending and receiving status of the slats as well as their tilting status. The slats of conventional Venetian blinds are made of opaque material or material of low penetrability to light, for example, plastic or wooden material. When the slats of a Venetian blind turned from a horizontal position to a vertical position to block the light, light rays can still pass through the gaps between each two adjacent slats, affecting the light blocking effect of the blind.

FIGS. 13 and 14 show a combination window covering according to the prior art. This structure of combination window covering 90 comprises a plurality of fabric sheets 92 respectively fastened to the plastic (or wooden) slats 91. The light penetrability of the fabric sheets 92 is relatively higher than the slats 91. The fabric sheets 92 each have a mounting portion 93 covered on the top surface of the corresponding slat 91, and a suspension portion 94 suspended from the front long side of the corresponding slat 91. The suspension portions 94 of the fabric sheets 92 are respectively overlapped on one another, forming a light screening face at the front sides of the slats 91.

The aforesaid combination window covering 90 still has drawbacks. Because the slats 91 and the fabric sheets 92 are made of different materials and then respectively coupled together, the fabrication and installation of this design of combination window covering 90 are complicated. Because the mounting portion 93 of each fabric sheet 92 is approximately equal to the size of the slats 91, much material is wasted, thereby increasing the manufacturing cost of the combination window covering 90. Furthermore, because the slats 91 are made of plastics, wood, or metal, the combination window covering 90 blocks the light (the sight) completely when the slats 91 set in vertical, i.e., people cannot see through the combination window covering 90 when the combination window covering 90 closed.

It is therefore desirable to provide a combination window covering that eliminates the aforesaid drawback.

SUMMARY OF THE INVENTION

It is the main object of the present invention to provide a combination window covering, which has a simple structure, and is inexpensive to manufacture.

It is another object of the present invention to provide a combination window covering, which softens the light, producing a warm and pleasant lighting atmosphere in the house.

To achieve these objects of the present invention, the combination window covering comprises a headrail; a bottom rail arranged in parallel to and spaced below the headrail; two ladder tape sets each having a front ladder tape and a rear ladder tape respectively vertically connected between the headrail and the bottom rail at front and rear sides; a plurality of slats arranged in parallel between the headrail and the bottom rail and between the front ladder tapes and rear ladder tapes of the ladder tape sets, the slats each having opposite long front and rear sides and two ribs respectively embedded in the front and rear sides, the ribs being respectively fastened to the front ladder tapes and rear ladder tapes of the ladder tape sets; a plurality of narrow, elongated, rectangular light screening flaps made of fabric and suspended from the slats and forming at least one light screening face at at least one of the front and rear sides of the slats, the light screening flaps having a length approximately equal to the slats, the light screening flaps each having a first long side fastened to one of the front and rear sides of one of the slats and a second long side opposite to the first long side; and a control unit for operation by the user to lift or lower the bottom rail so as to further receive or extend out the slats, and to move the front ladder tapes and rear ladder tapes of the ladder tape sets vertically in reversed directions so as to further tilt the slats.

DETAILED DESCRIPTION OF THE INVENTION

Figure 1:
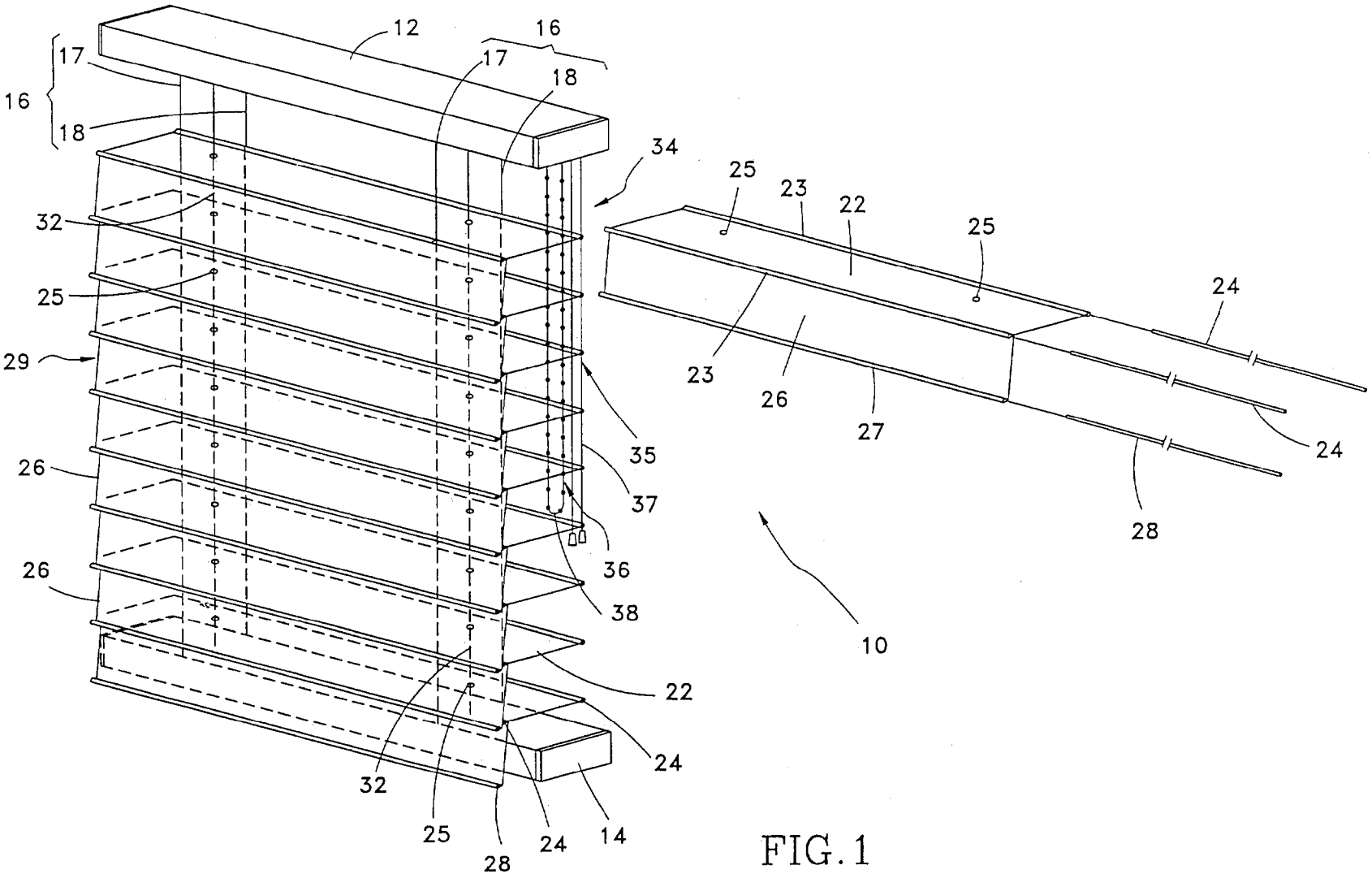
FIG. 1 is an exploded view of a combination window covering according to a first preferred embodiment of the present invention.
Figure 2:
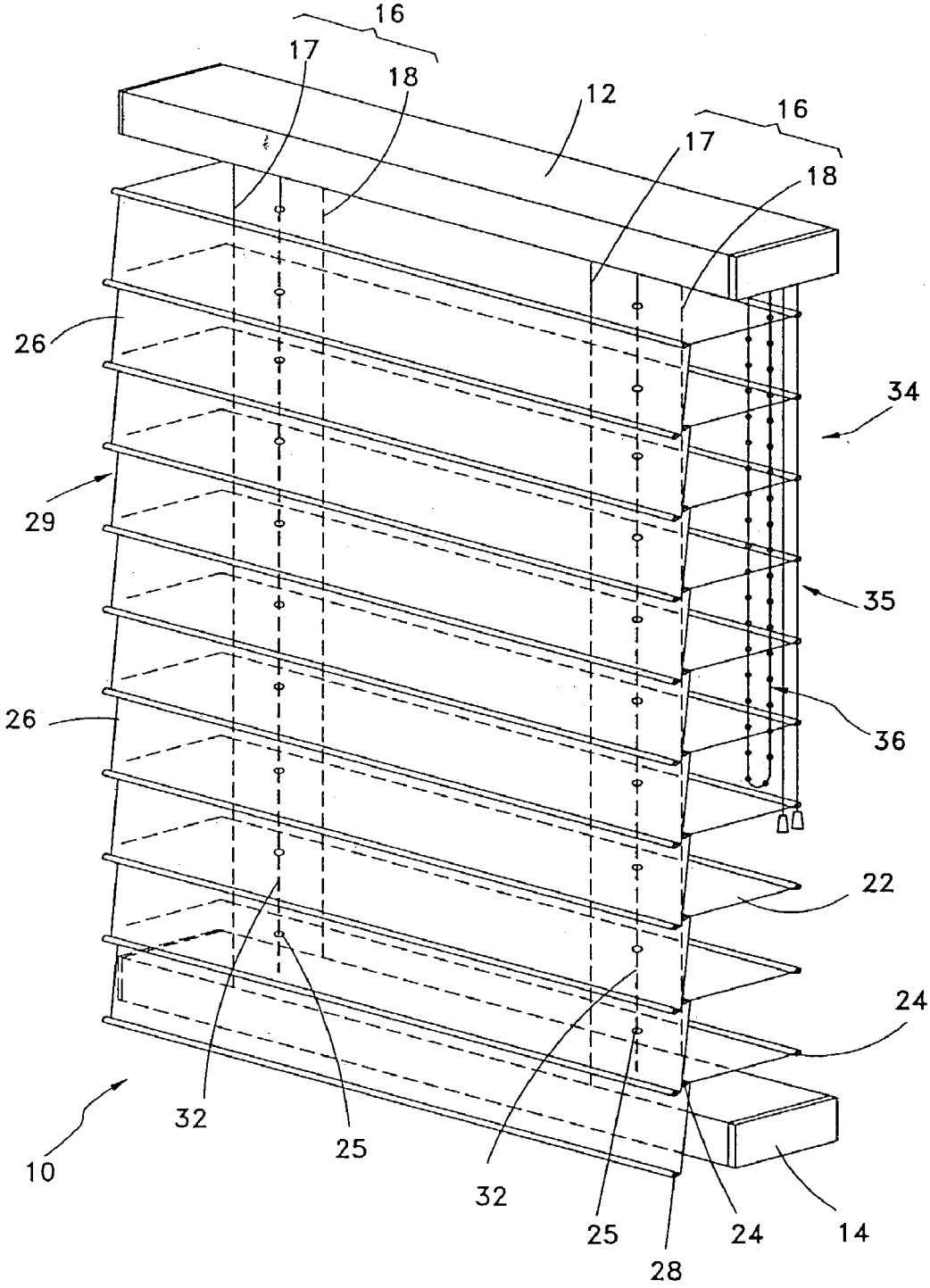
FIG. 2 is a perspective assembly view of the combination window covering according to the first preferred embodiment of the present invention.
Figure 3:
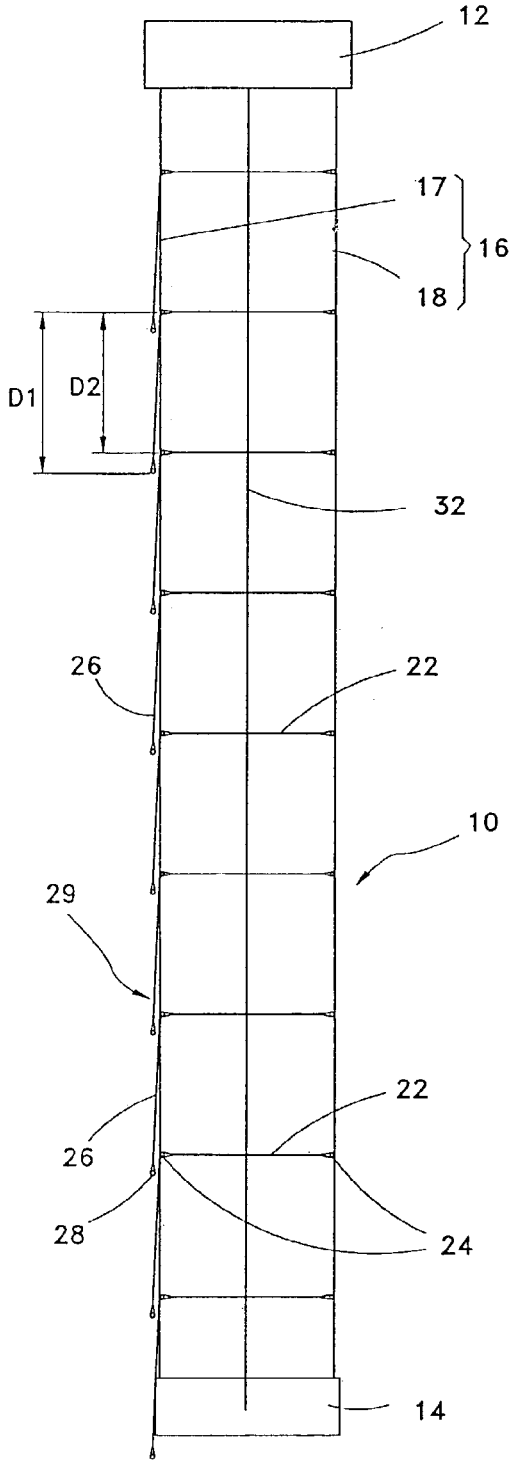
FIG. 3 is a side view of the combination window covering according to the first preferred embodiment of the present invention, showing the flexible slats set in a fully lowered, open position.

Referring to FIGS. 1~3, a combination window covering 10 in accordance with the first preferred embodiment of the present invention is shown comprised of a headrail 12, a bottom rail 14, two ladder tape sets 16, a plurality of slat units having a plurality of flexible slats 22 and a plurality of flexible light screening flaps 26, two lift cords 32, and a control unit 34.

The headrail 12 is a hollow frame bar transversely (horizontally) affixed to the top side of a window (not shown).

The bottom rail 14 is a hollow frame bar arranged in parallel to and suspended below the headrail 12.

The ladder tape sets 16 each is comprised of a front ladder tape 17 and a rear ladder tape 18. As can be seen in the upper portion of FIG. 1, there are no rungs between the ladder tapes or rails 17 and 18. The front and rear ladder tapes 17 and 18 each have a top end respectively inserted into the inside of the headrail 12 (this will be described further) and a bottom end fixedly connected to the bottom rail 14. According to this embodiment, the ladder tapes 17 and 18 of the ladder tape sets 16 are symmetrically provided at two sides. Subject to the transverse width of the window, the combination window covering can be equipped with more than two ladder tape sets.

The flexible slats 22 of the slat units are narrow, elongated, rectangular members made of fabric of low penetrability to light, and arranged in parallel between the headrail 12 and the bottom rail 14 within the space defined between the front ladder tapes 17 and the rear ladder tapes 18. Each slat 22 comprises two sleeves 23 respectively extended along the respective two opposite long sides, two plastic ribs 24 respectively inserted into the sleeves 23 and respectively fastened to the front ladder tapes 17 and the rear ladder tapes 18, and two through holes 25 for the passing of the lift cords 32. The plastic ribs 24 support the respective flexible slat 22 maintaining its shape. The sleeves 23 have notches (not shown) so that respective retainer rings (not shown) of the ladder tapes 17 and 18 can be respectively fastened to the plastic ribs 24.

The flexible light screening flaps 26 of the slat units are rectangular pieces of thin layers of mesh fabric through which light may pass equal to the length and number of the flexible slats 22, having a permeability to light relatively higher than the slats 22, each having one long side stitched to the front long side (the side facing the inside of the room) of one flexible slat 22 and the other long side provided with a sleeve 27 and a rib 28 in the sleeve 27. As illustrated in FIG. 3, the flexible light screening flaps 26 are respectively vertically suspended from the flexible slats 22. The width $D_1$ of the flexible light screening flaps 26 are slightly greater than the pitch $D_2$ between two adjacent flexible slats 22 (the pitch between each two vertically spaced adjacent retainer rings at each of the front and rear ladder tapes). Therefore, when the flexible light screening flaps 26 vertically suspended from the flexible slats 22, the bottom side edge of each flexible light screening flap 26 is lower than the elevation of the front long side of the respective flexible slat 22 blow, i.e., the bottom side edge of each flexible light screening flap 26 is covered on the front long side of the next flexible slat 22. Therefore, the flexible light screening flaps 26 form a light screening face 29 at the front side of the combination window covering 10, as shown in FIG. 2. In the same way, flexible light screening flaps may be respectively fastened to the rear long side of each of the flexible slats to from a light screening face at the rear side of the combination window covering.

The lift cords 32 are symmetrically disposed at left and right sides and respectively inserted through the through holes 25 of the flexible slats 22, each having a top end mounted in the headrail 12 (this will be described further) and a bottom end fixedly fastened to the bottom rail 14.

The control unit 34 comprises a lift control mechanism 35 and a tilt control mechanism 36. The lift control mechanism 35 is to be operated by the user to lift or lower the bottom rail 14, so as to further receive or extend out the flexible flats 22. The tilt control mechanism 36 is adapted to control relative movement of the front ladder tapes 17 and the rear ladder tapes 18 vertically in reversed directions, so as to further tilt the flexible slats 22. The control unit 34 is of the known art, comprising two rod members (not shown) fastened rotatably with the inside of the headrail 12, two pairs of reels (not shown) respectively mounted on the rod members, a lift-control operation cord set 37 and a tilt-control operation chain set 38 respectively coupled to the rod members for operation by the user to rotate the rod members respectively. The top ends of the lift cords 32 are respectively fastened to the two reels at one rod member. The front ladder tapes 17 and rear ladder tapes 18 of the ladder tape sets 16 are respectively coupled to the reels of the other rod member at two sides. Because the control unit is of the known art and not within the scope of the claims of the present invention, no further detailed description in this regard is necessary.

Figure 4:
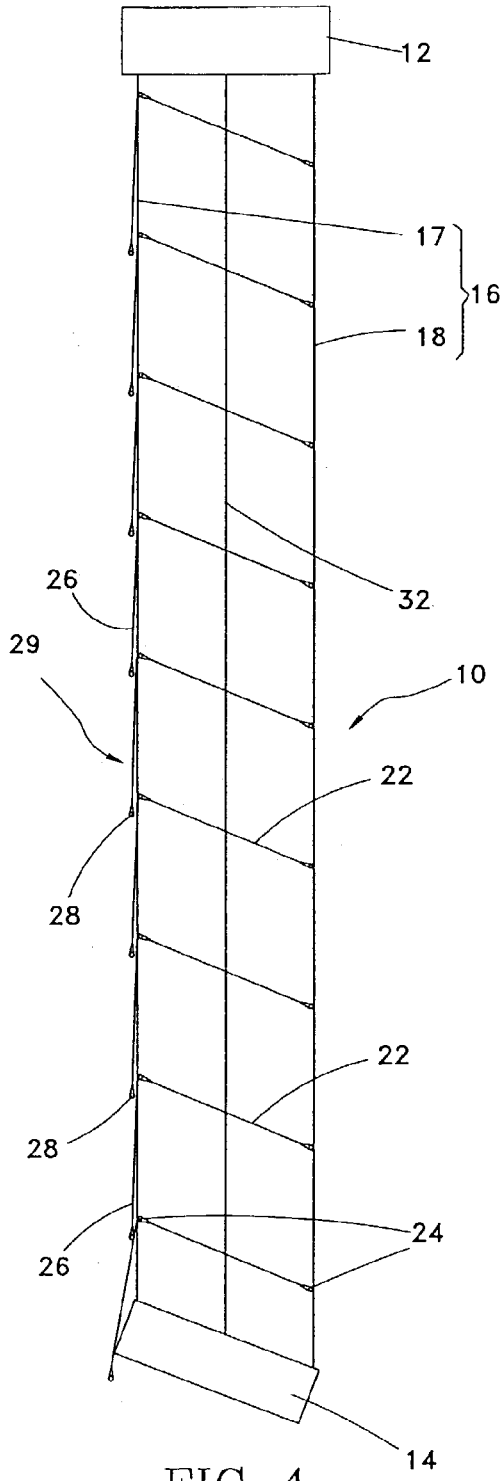
FIG. 4 is similar to FIG. 3 but showing the flexible slats tilted.

When the aforesaid combination window covering 10 is assembled, the flexible slats 22 block the light or the sight between the outside of the room and the inside of the room. By means of operating the tilt control mechanism 36 of the control unit 34 to move the front ladder tapes 17 and the rear ladder tapes 18 in opposite directions, the flexible slats 22 are tilted to regulate the light, as shown in FIGS. 3 and 4.

The flexible light screening flaps 26 are vertically suspended from the flexible slats 22 at the front side (the ribs 28 of the flexible light screening flaps 26 support the front long side of each flexible light screening flap 26 in shape and, stabilize and smoothen the suspension of he flexible light screening flaps 26), forming the aforesaid light screening face 29 at the front side of the combination window covering 10. The light screening face 29 screens and softens the light, producing a tender and pleasant lighting atmosphere in the room.

Figure 5:
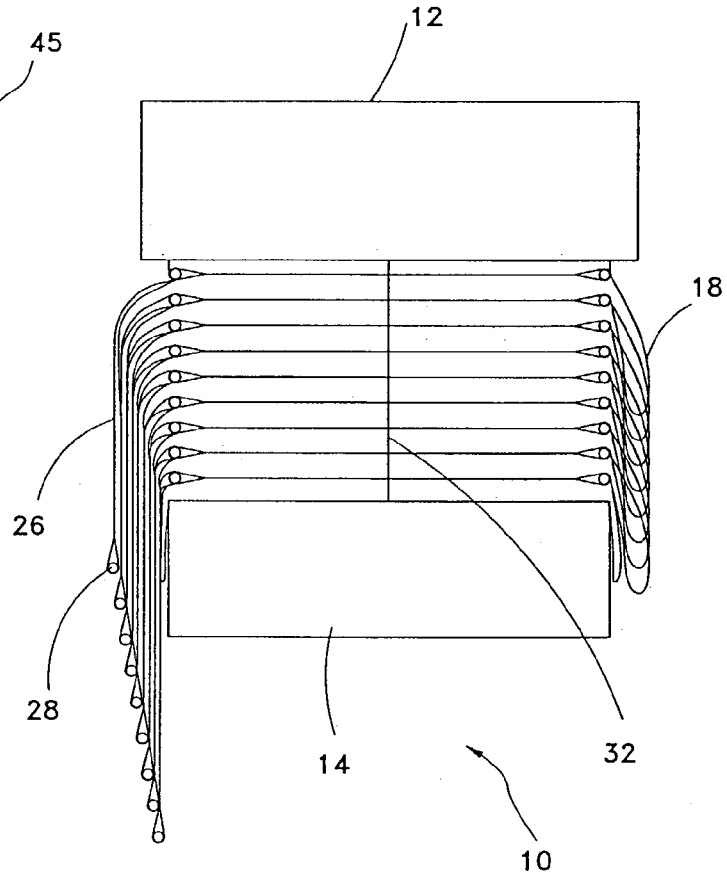
FIG. 5 is a side view of the first embodiment of the present invention, showing the combination window covering in a fully raised, open position.

When operating the lift control mechanism 35 of the control unit 34 to roll up the lift cords 32, the bottom rail 14 is lifted, and the flexible slats 22 are raised to the fully raised, open position shown in FIG. 5. When the flexible slats 22 are fully raised, the flexible light screening flaps 26 are overlapped on one another in order as shown in the figure.

In comparison with other conventional products having similar functions, the combination window covering 10 of the present invention has a simple structure and is easy to manufacture. Further, it is practical to have the flexible slats and the light screening flaps made of same fabric material, i.e., each light screening flap and the corresponding flexible slat can be formed of one single piece of fabric, so as to reduce the cost. Alternatively, one single piece of fabric can be processed to form a flexible slat and an integrated light screening flap light screening flap by coating a part of the single piece of fabric with a layer of film or color paint over the area for flexible slat.

As indicated above, the flexible slats as well as the light screening flaps of the combination window covering of the present invention are respectively made of fabric instead of conventional plastic or wooden material. Therefore, the combination window covering softens the light, producing a tender and pleasant atmosphere in the house.

Figure 7:
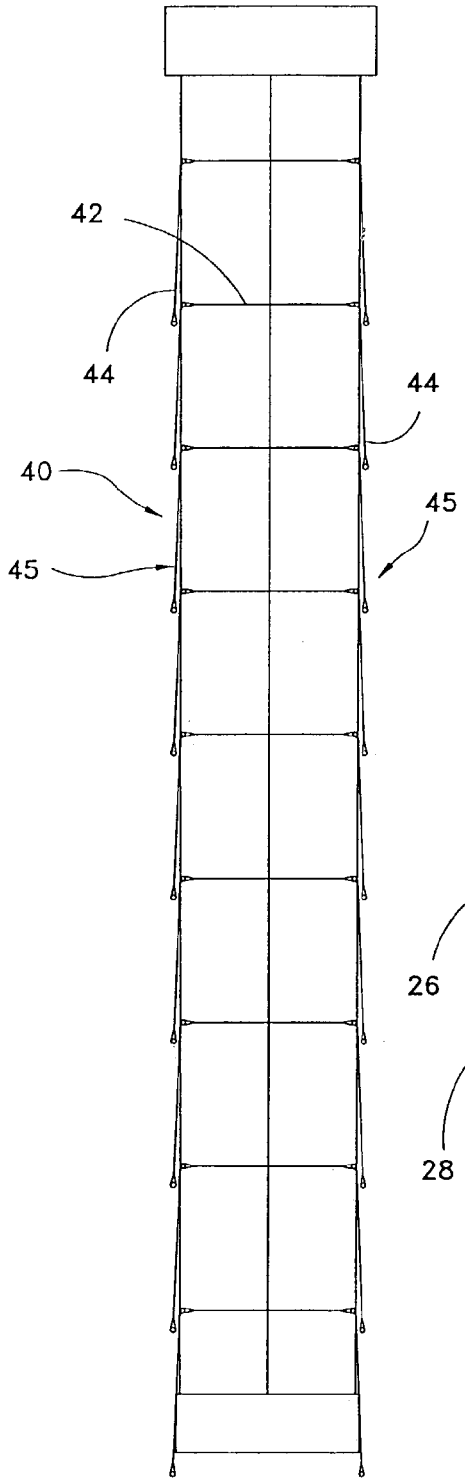
FIG. 7 is a side view of the combination window covering according to the second preferred embodiment of the present invention, showing the flexible slats set in a fully lowered, open position.
Figure 6:
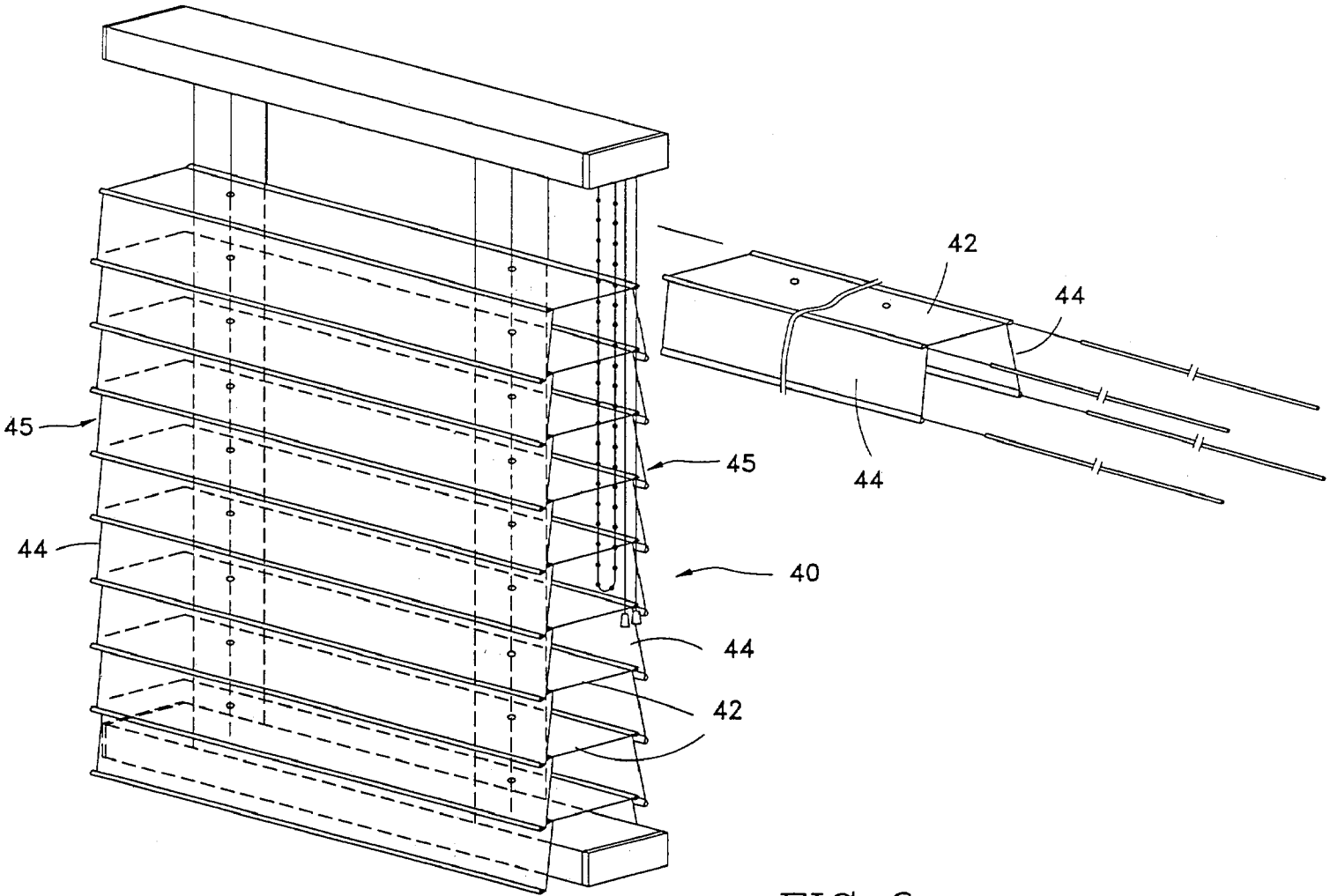
FIG. 6 is an exploded view of a combination window covering according to a second preferred embodiment of the present invention.

FIGS. 6 and 7 show a combination window covering 40 constructed according to the second preferred embodiment of the present invention. This embodiment is similar to the aforesaid first preferred embodiment with the exception the arrangement of flexible light screening flaps. According to this embodiment, flexible light screening flaps 44 of the slat units are respectively provided at the front and rear long sides of the flexible slats 42 of the slat units, forming a respective light screening face 45 at the front and rear sides of the flexible slats 42.

Figure 8:
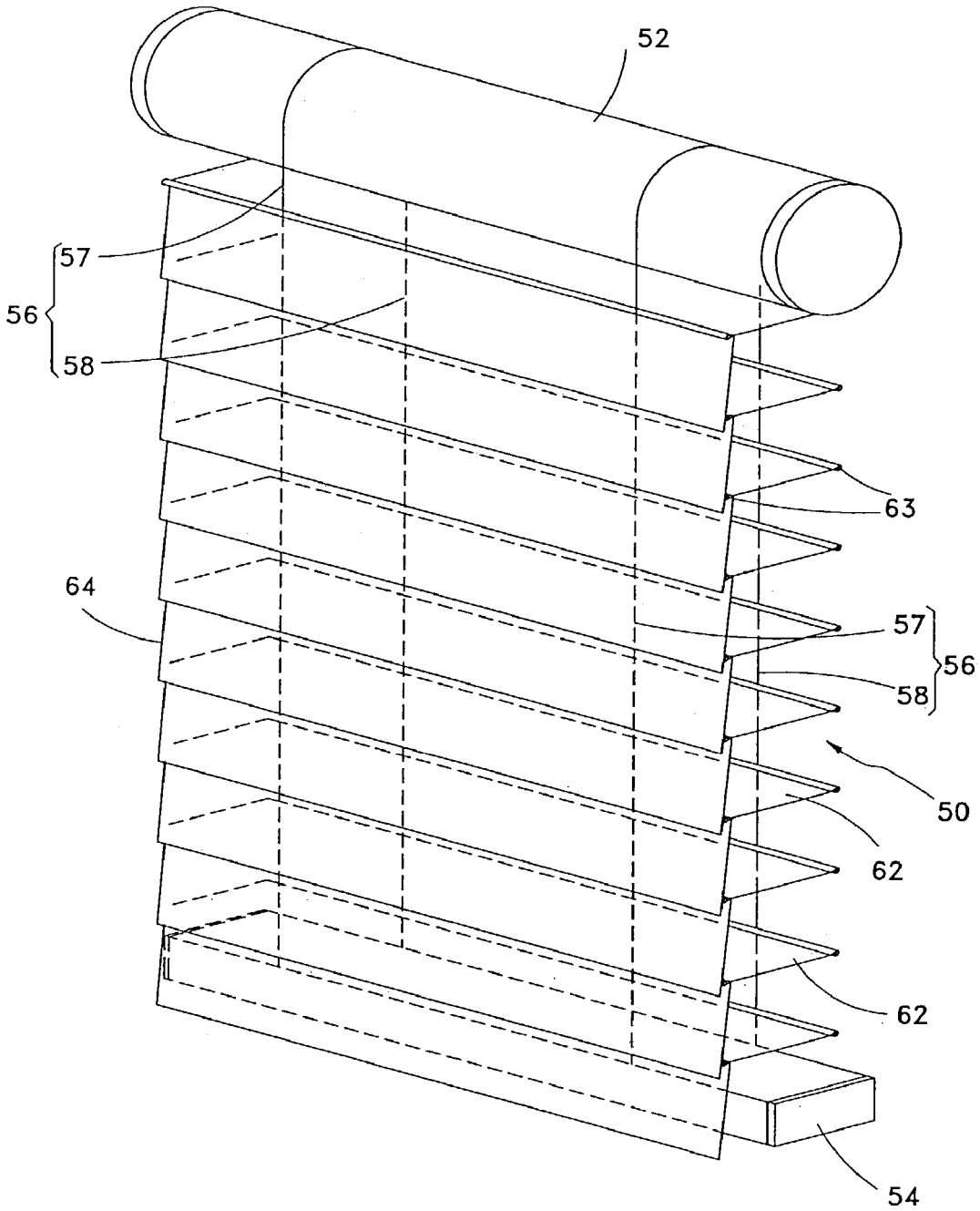
FIG. 8 is a perspective view of a combination window covering according to a third preferred embodiment of the present invention.
Figure 9:
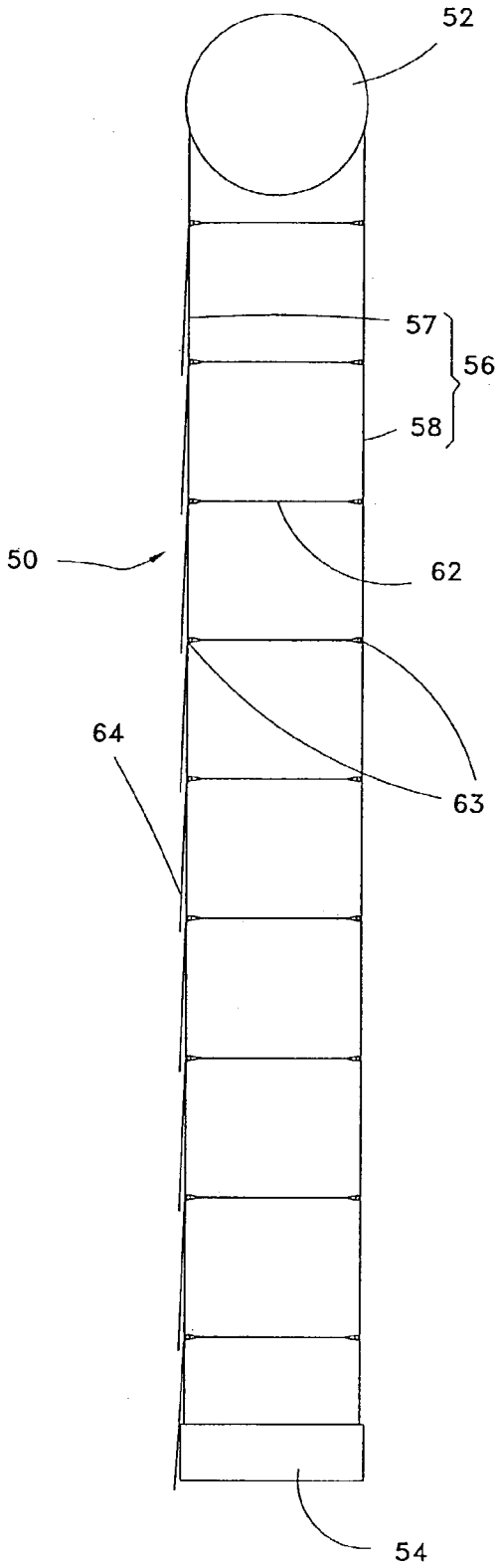
FIG. 9 is a side view of the combination window covering according to the third preferred embodiment of the present invention, showing the flexible slats set in a fully lowered, open position.

The combination window covers according to the aforesaid first and second embodiments are constructed subject to the design of a Venetian blind. Alternatively, the invention can also be used in a roll up window blind assembly. FIGS. 8 and 9 show a combination window covering 50 constructed according to the third preferred embodiment of the present invention. According to this embodiment, the combination window covering 50 comprises:

a headrail 52 shaped like a barrel and transversely (horizontally) fastened rotatably with the top side of a window (not shown) for free rotation on its own axis;

a bottom rail 54 horizontally spaced below the headrail 52;

two ladder tape sets 56 bilaterally vertically arranged in parallel, each ladder tape set 56 including a front ladder tape 57 and a rear ladder tape 58, the front and rear ladder tapes 57 and 58 each having a top end fixedly connected to the headrail 52 and a bottom end fixedly connected to the bottom rail 54;

a plurality of flexible slats 62 respectively made of a narrow elongated strip of fabric and arranged in parallel between the headrail 52 and the bottom rail 54, each flexible slat 62 having two rims 63 respectively embedded in two hemmed long sides thereof and connected respectively to the front and rear ladder tapes 57 and 58;

a plurality of light screening flaps 64 respectively made of fabric having a permeability to light relatively higher than the flexible slats 62, and respectively stitched to and suspended from the front long side of each of the flexible slats 62; and a control unit (not shown, of the known art) for operation by the user to slightly rotate the headrail 52 so as to tilt the slats 62.

Figure 10:
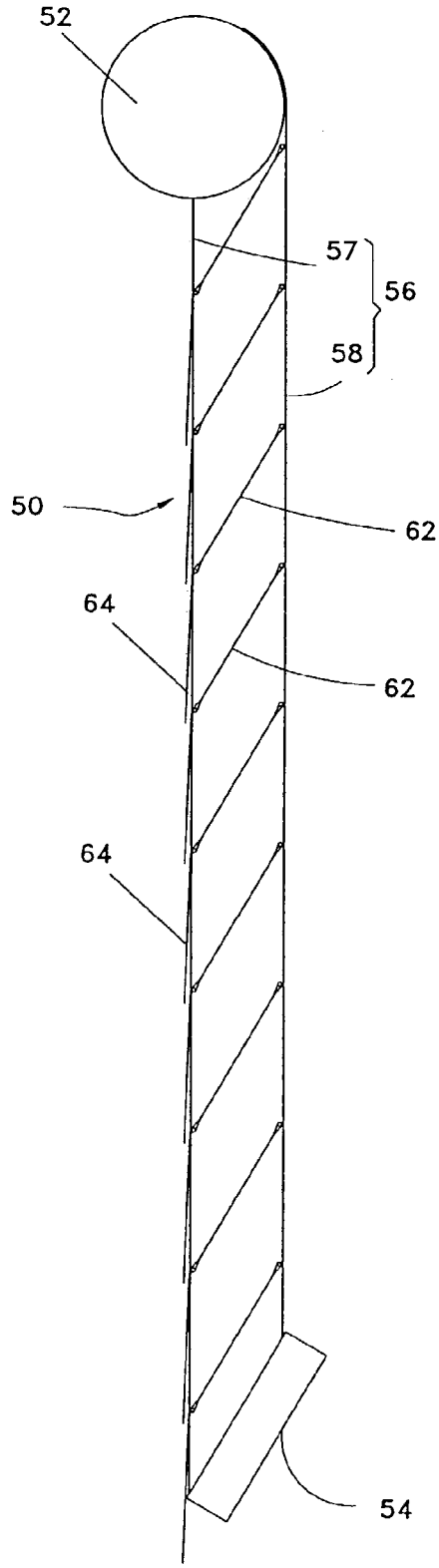
FIG. 10 is another side view of the combination window covering according to the third preferred embodiment of the present invention, showing the flexible slats tilted.
Figure 11:
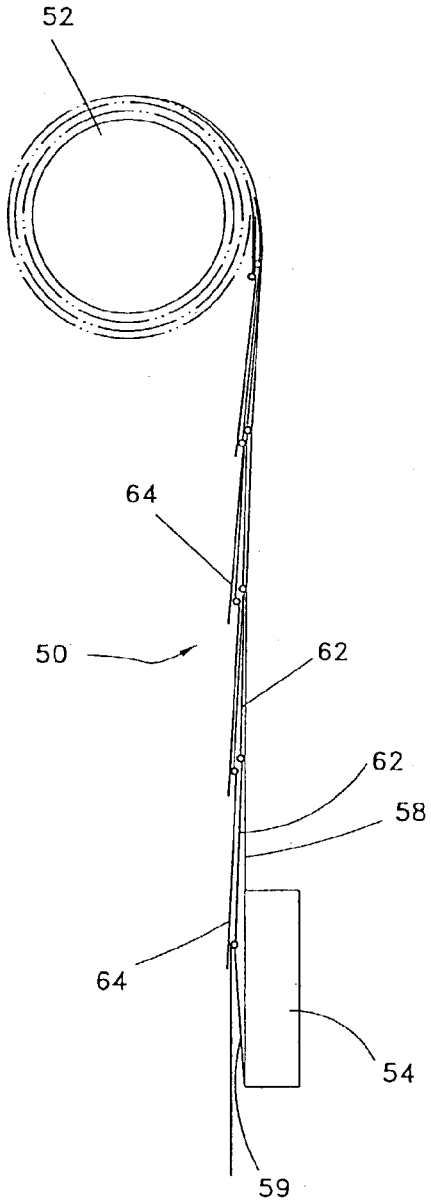
FIG. 11 is another side view of the combination window covering according to the third preferred embodiment of the present invention, showing the window covering slats fully tilted and being rolled onto a drum.

When rotating the headrail 52 through an angle, the front ladder tapes 57 and the rear ladder tapes 58 are moved vertically in reversed directions, thereby causing the flexible slats 62 to be tilted as shown in FIG. 10. When continuously rotating the headrail 52, the ladder tape sets 56 are rolled up on the periphery of the headrail 52, thereby causing the bottom rail 54, the flexible slats 62 and the light screening flaps 64 to be respectively around the periphery of the headrail 52 as shown in FIG. 11.

Figure 12:
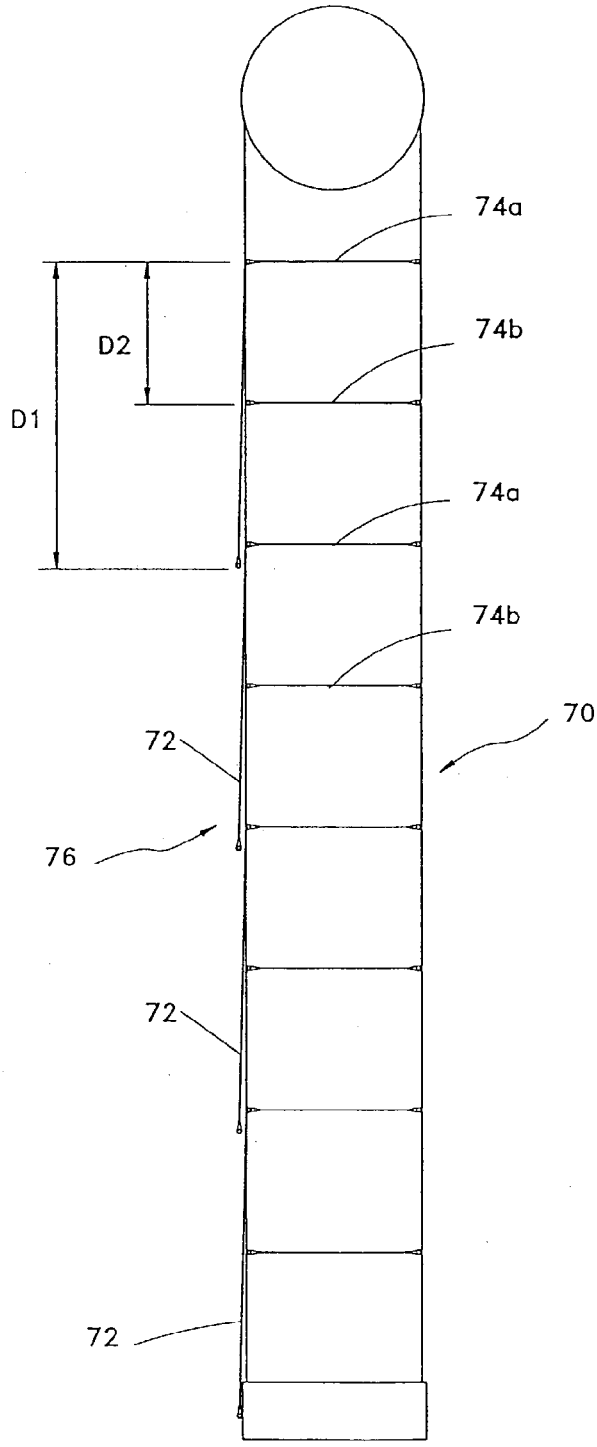
FIG. 12 is a side view of a combination window covering according to a fourth preferred embodiment of the present invention in a fully lowered, open position.
Figure 13:
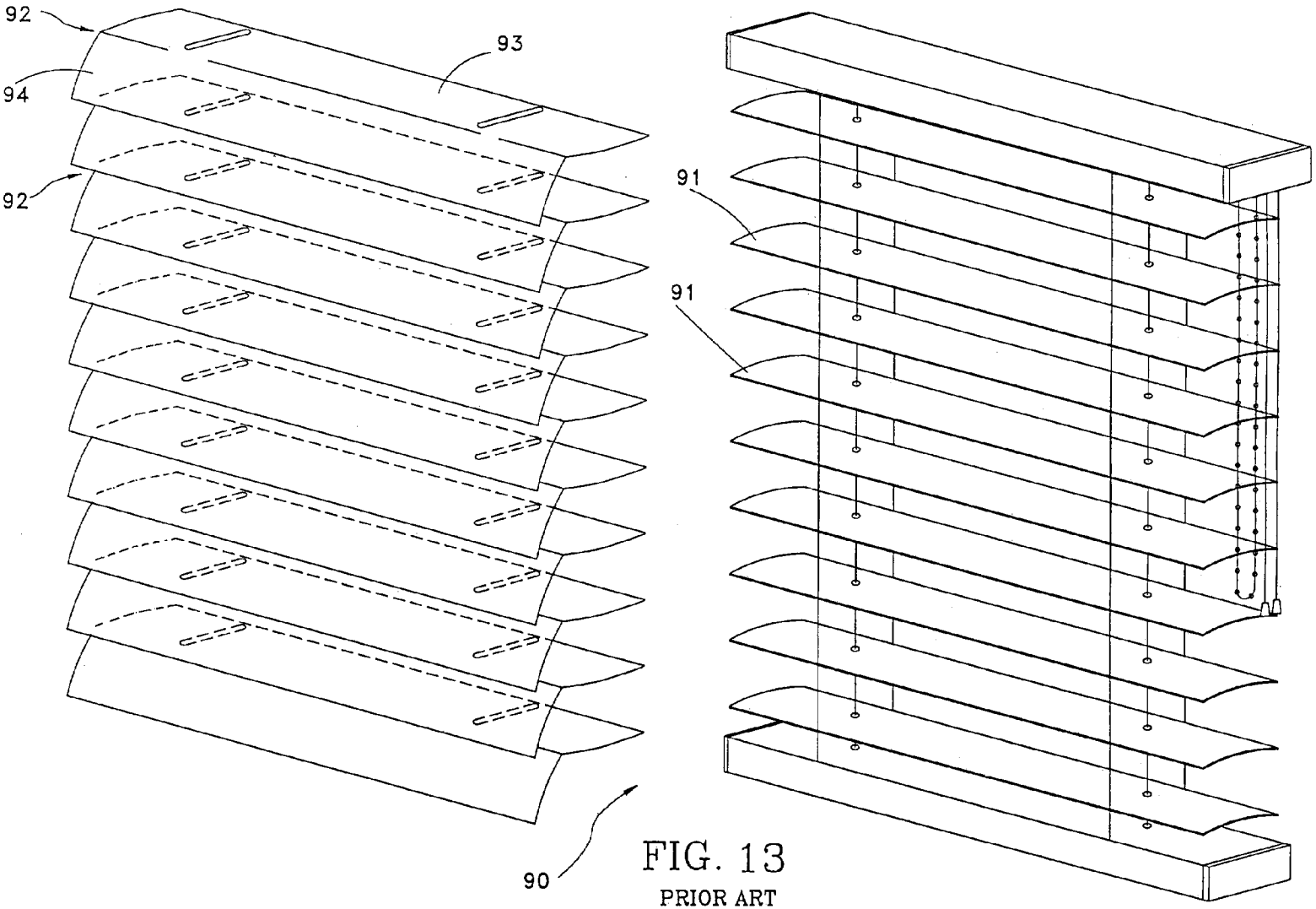
FIG. 13 PRIOR ART
FIG. 13 is a perspective exploded view of a combination window covering according to the prior art.
Figure 14:
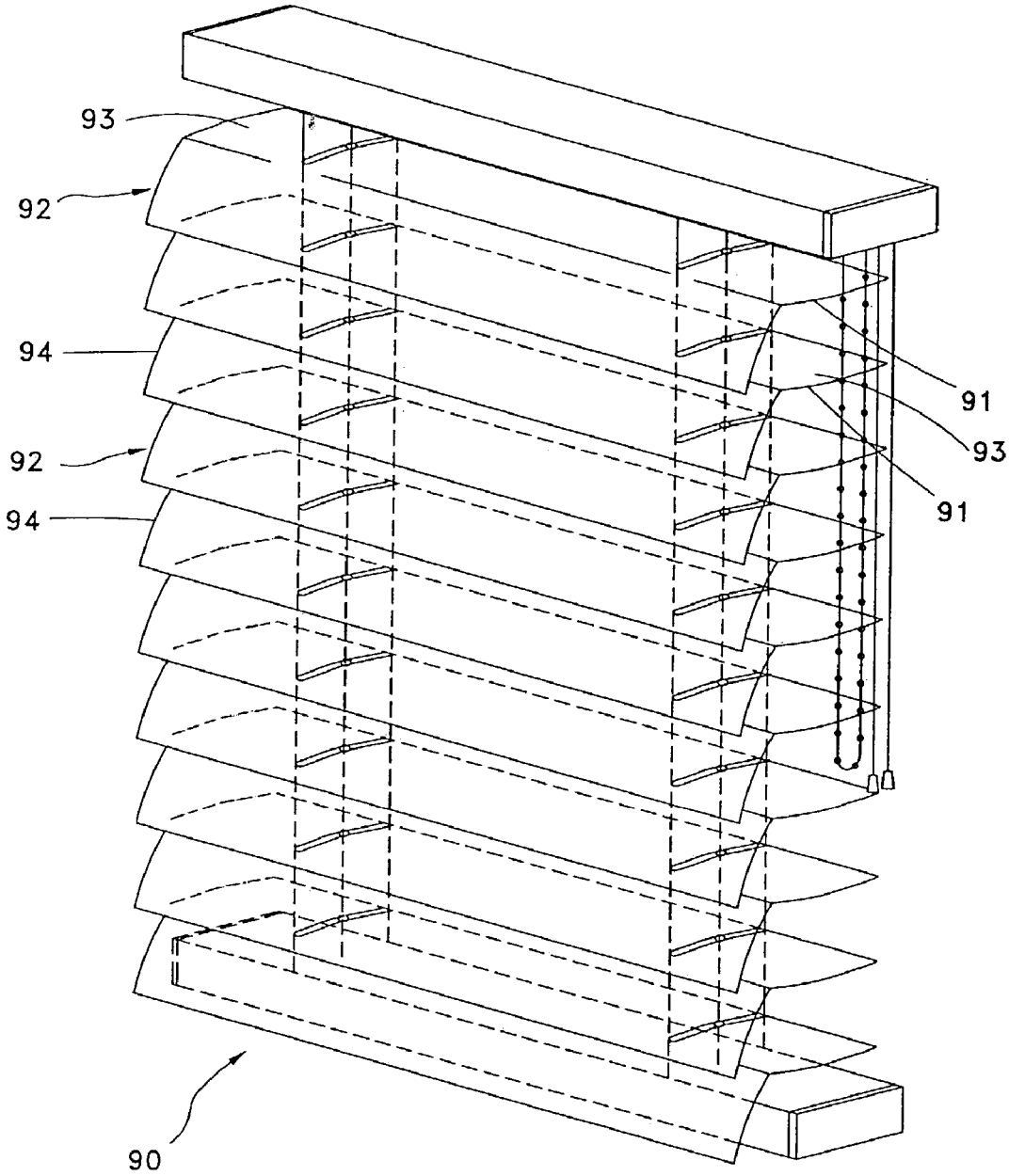
FIG. 14 PRIOR ART
FIG. 14 is a perspective assembly view of a combination window covering according to the prior art.

FIG. 12 shows a combination window covering 70 according to the fourth preferred embodiment of the present invention. According to this embodiment, the light screening flaps 72 of the slat units are respectively fastened to and suspended from the front long side of each of the odd number flexible slats 74*a* of the slat units. The even number flexible slats 74*b* are not provided with any light screening flaps. The width $D_1$ of the light screening flaps 72 is about twice the pitch $D_2$ between each two adjacent flexible slats 74*a* and 74*b*, i.e., each light screening flap 72 extends from the front side of one odd number flexible slat 74*a* over the adjacent even number flexible slat 74*b* below to the front side of the next odd number flexible slat 74*a*. Similarly, the flexible light screening flaps 72 form a light screening face 76 at the front side of the flexible slats 74*a* and 74*b*.

What is claimed is:

1. A combination window covering comprising:

a headrail adapted to be fastened horizontally to a top side of a window;

a bottom rail arranged in parallel to and spaced below said headrail;

at least two ladder tape sets each comprising a front ladder tape and a rear ladder tape respectively vertically connected between said headrail and said bottom rail;

a plurality of slats made of fabric and arranged in parallel between said headrail and said bottom rail and between the front ladder tapes and rear ladder tapes of said ladder tape sets, said slats each having opposite long front and rear sides and two ribs respectively embedded in the long front and rear sides, said ribs being respectively fastened to the front ladder tapes and rear ladder tapes of said ladder tape sets;

a plurality of light screening flaps made of mesh fabric through which light may pass and suspended from said slats and forming at least one light screening face on at least one of the front and rear sides of said slats, said light screening flaps having a length approximately equal to said slats, said light screening flaps each having a first long side fastened to one of the front and rear sides of one of said slats and a second long side opposite to said first long side;

a rib embedded in the second long side of each light screening flap; and a control unit for operation by the user to lift or lower said bottom rail so as to further receive or extend out said slats, and to move the front ladder tapes and rear ladder tapes of said ladder tape sets vertically in reversed directions so as to further tilt said slats.

2. The combination window covering as claimed in claim 1, wherein said slats and said light screening flaps are light penetrable, and said light screening flaps have a light penetrability higher than said slats.

3. The combination window covering as claimed in claim 2, wherein said light screening flaps are fastened to said slats by stitches.

4. The combination window covering as claimed in claim 1, wherein each pair of adjacent slats is separated by a pitch, said light screening flaps are respectively fastened to and suspended from one of the front and rear sides of each of said slats, and the width between the first and second long sides of each of said light screening flaps is approximately equal to the pitch between each two adjacent slats.

5. The combination window covering as claimed in claim 1, wherein light screening flaps are respectively fastened to and suspended from one of the front and rear sides of each of said slats, each pair of adjacent slats is separated by a pitch, and a width between the first and second long sides of each of said light screening flaps is greater than the pitch between each two adjacent slats so that the first long side of each of said light screening flap is fastened to one of said slats and the second long side of each of said light screening flaps covers over one of the front and rear sides of a next slat below the slat to which the respective light screening flap is fastened.

6. The combination window covering as claimed in claim 1, wherein each pair of adjacent slats is separated by a pitch, and said light screening flaps are selectively fastened to said slats, and have a width about twice the pitch between each two adjacent slats.

7. The combination window covering as claimed in claim 1, wherein each pair of adjacent slats is separated by a pitch, and said light screening flaps are selectively fastened to said slats, and have a width greater than twice the pitch between each two adjacent slats.

8. The combination window covering as claimed in claim 1, wherein said light screening flaps are respectively fastened to the front and rear sides of said slats, forming two light screening faces at the front and rear sides of said slats.

9. A combination window covering comprising:

a headrail adapted to be fastened horizontally to a top side of a window;

a bottom rail arranged in parallel to and spaced below said headrail;

at least two ladder tape sets each comprising a front ladder tape and a rear ladder tape respectively vertically connected between said headrail and said bottom rail;

a plurality of slats made of fabric and arranged in parallel between said headrail and said bottom rail and between the front ladder tapes and rear ladder tapes of said ladder tape sets, said slats each having opposite long front and rear sides and two ribs respectively embedded in the long front and rear sides, said ribs being respectively fastened to the front ladder tapes and rear ladder tapes of said ladder tape sets;

a plurality of light screening flaps made of fabric and suspended from said slats and forming at least one light screening face on at least one of the front and rear sides of said slats, said light screening flaps having a length approximately equal to said slats, said light screening flaps each having a first long side fastened to one of the front and rear sides of one of said slats and a second long side opposite to said first long side; and a control unit for operation by the user to lift or lower said bottom rail so as to further receive or extend out said slats, and to move the front ladder tapes and rear ladder tapes of said ladder tape sets vertically in reversed directions so as to further tilt said slats;

wherein said headrail has a first rod member and a second rod member rotatable by said control unit; the front ladder tapes and rear ladder tapes of said at least two ladder tape sets each have a top end respectively fastened to said first rod member for enabling said rod members to roll up said at least two ladder tape sets upon rotation; the combination window covering further comprises at least two lift cords vertically connected in parallel between said second rod member and said bottom rail.

10. The combination window covering as claimed in claim 9, wherein said slats have a plurality of through holes through which said lift cords pass.

11. A slat unit for a combination window covering comprising:

a slat made of fabric having opposite long front and rear sides and two ribs respectively embedded in the long front and rear sides;

a light screening flap made of mesh fabric through which light may pass and suspended downwardly from said slat when said slat is horizontally arranged in the combination window covering, said light screening flap having a first long side fastened to one of the front and rear sides of said slat and a second long side opposite to said first long side; and a rib embedded in the second long side of the light screening flap.

12. The slat unit as defined in claim 11, wherein said slat and said light screening flap are light penetrable, and said light screening flap has a light penetrability higher than said slats.

* * * * *